US007819784B1

(12) United States Patent
Caswell et al.

(10) Patent No.: US 7,819,784 B1
(45) Date of Patent: Oct. 26, 2010

(54) SUSPENSION GYM

(75) Inventors: Charles Caswell, Tulsa, OK (US); Richard Davis, Owasso, OK (US)

(73) Assignee: Gofit, L.L.C., Tulsa, OK (US)

( * ) Notice: Subject to any disclaimer, the term of this patent is extended or adjusted under 35 U.S.C. 154(b) by 143 days.

(21) Appl. No.: 12/277,638

(22) Filed: Nov. 25, 2008

(51) Int. Cl.
*A63B 21/00* (2006.01)

(52) U.S. Cl. ..... 482/95; 482/96; 482/904

(58) Field of Classification Search ..... 482/121, 482/129, 904, 39, 40, 124
See application file for complete search history.

(56) References Cited

U.S. PATENT DOCUMENTS

| | | | | |
|---|---|---|---|---|
| 448,305 | A * | 3/1891 | Thayer | 482/102 |
| 2,919,134 | A | 12/1959 | Zuro | |
| 4,316,609 | A * | 2/1982 | Silberman | 482/102 |
| 4,431,184 | A * | 2/1984 | Lew et al. | 482/43 |
| 5,029,850 | A | 7/1991 | Van Straaten | |
| 5,050,869 | A | 9/1991 | Frate | |
| 5,221,240 | A | 6/1993 | Mann et al. | |
| 5,468,205 | A | 11/1995 | McFall et al. | |
| 5,540,641 | A | 7/1996 | Williams et al. | |
| 5,624,360 | A | 4/1997 | Wilkins | |
| 6,059,698 | A | 5/2000 | Mazor | |
| 6,508,743 | B1 | 1/2003 | Fortin | |
| 6,908,418 | B2 | 6/2005 | Saure | |

* cited by examiner

*Primary Examiner*—Jerome Donnelly

(57) ABSTRACT

A piece of exercise equipment or gym that is secured to either side of a door frame via brackets that are permanently secured to the sides of the door frame across the upper end of a doorway. The gym has an adjustable length rod that is removably suspended between the brackets. A rotatable ring or connection point secured centrally on the rod supports two adjustable length straps. The free end of each strap is provided with a ring to which handles or stirrups can be attached. Also, the rod itself has rubber grips on it and is provided with additional multi-purpose rings where handles or stirrups can be attached.

12 Claims, 5 Drawing Sheets

SUSPENSION GYM

BACKGROUND OF THE INVENTION

1. Field of the Invention

The present invention is a piece of exercise equipment or gym that is secured to either side of a door frame via brackets that are permanently secured to the sides of the door frame. The gym has an adjustable length rod that is removably suspended across the upper end of a doorway opening between the brackets. A rotatable ring or connection point secured centrally on the rod supports two adjustable length straps. The free end of each strap is provided with a ring to which handles or stirrups can be attached. Also, the rod itself has rubber grips on it and is provided with additional rings where handles or stirrups can be attached.

2. Description of the Related Art

Various types of exercise equipment have been created to serve as a home gym. Some of these devices lay flat on the floor, some lean against a wall, some mount to a door, and some attach to a door frame. Those devices that do not secure to an immovable object can fall over or move while being used. And certain exercises, such as pull-ups, require solid support. Those devices that secure to a door can slip off the door and the door can move during the exercise or the exercise can damage the door.

Of those that attach to a door frame, most often do so in a precarious manner, such as via friction or pressure fit, and do not allow the user the assurance that the device will not fall down when it is being used, particularly when being used in a vigorous manner or by a strong or heavy person.

Further many of the devices that attached to a door frame use rubber cords that can break, possibly causing injury to the user.

Another disadvantage associated with many of the devices that attached to a door frame is that they are not adjustable enough to allow the user to employ the devices for a variety of exercises or are not stable or strong enough to allow the user to perform for the desired exercises.

Still a further problem with many of the devices that attach to a door frame is that they must be removed from the door frame when not being used. Some of these devices are quite heavy and difficult to handle and are cumbersome to store between uses.

The present invention addresses all of these problems by providing a suspension gym that has an adjustable length rod that adjusts to fit most door frames and is securely suspended via permanent brackets that secure to the sides of the door frame. The present invention is strong, but light weight and can be easily removed from the supporting brackets for storage, if desired, or alternately, since it is mounted at the top of the door opening, can be left in place on the doorframe between uses. The present invention employs adjustable length straps that will not break and that provide the user with the flexibility needed to perform a wide variety of exercises in a safe manner alone or in conjunction with the rubber grip sleeves provided on the rod or with the multi-purpose rings that are also provided on the rod. Hand grips and ankle stirrups are removably attachable to adjustable length straps or to multi-purpose rings provided on the invention to further enhance its functionality.

SUMMARY OF THE INVENTION

The present invention is a piece of exercise equipment or gym that is suspended in a doorway opening. The equipment includes bracket means for mounting an adjustable length rod to either side of a door frame so that the rod extends across the upper end of the doorway opening. A rotatable ring or connection point secured centrally on the rod supports two adjustable length straps. Free ends of the adjustable length straps are provided with rings to which hand grips or ankle stirrups are removably attachable. Opposite ends of the adjustable length straps are adjustably secured one to either side of the door frame by a strap locking mechanism with a press release handle. Additionally, the rod is provided with a pair of rubber grip sleeves around the rod and with a pair of multi-purpose rings to which hand grips or ankle stirrups are removably attachable.

DETAILED DESCRIPTION OF THE PREFERRED EMBODIMENT

Figure 1:
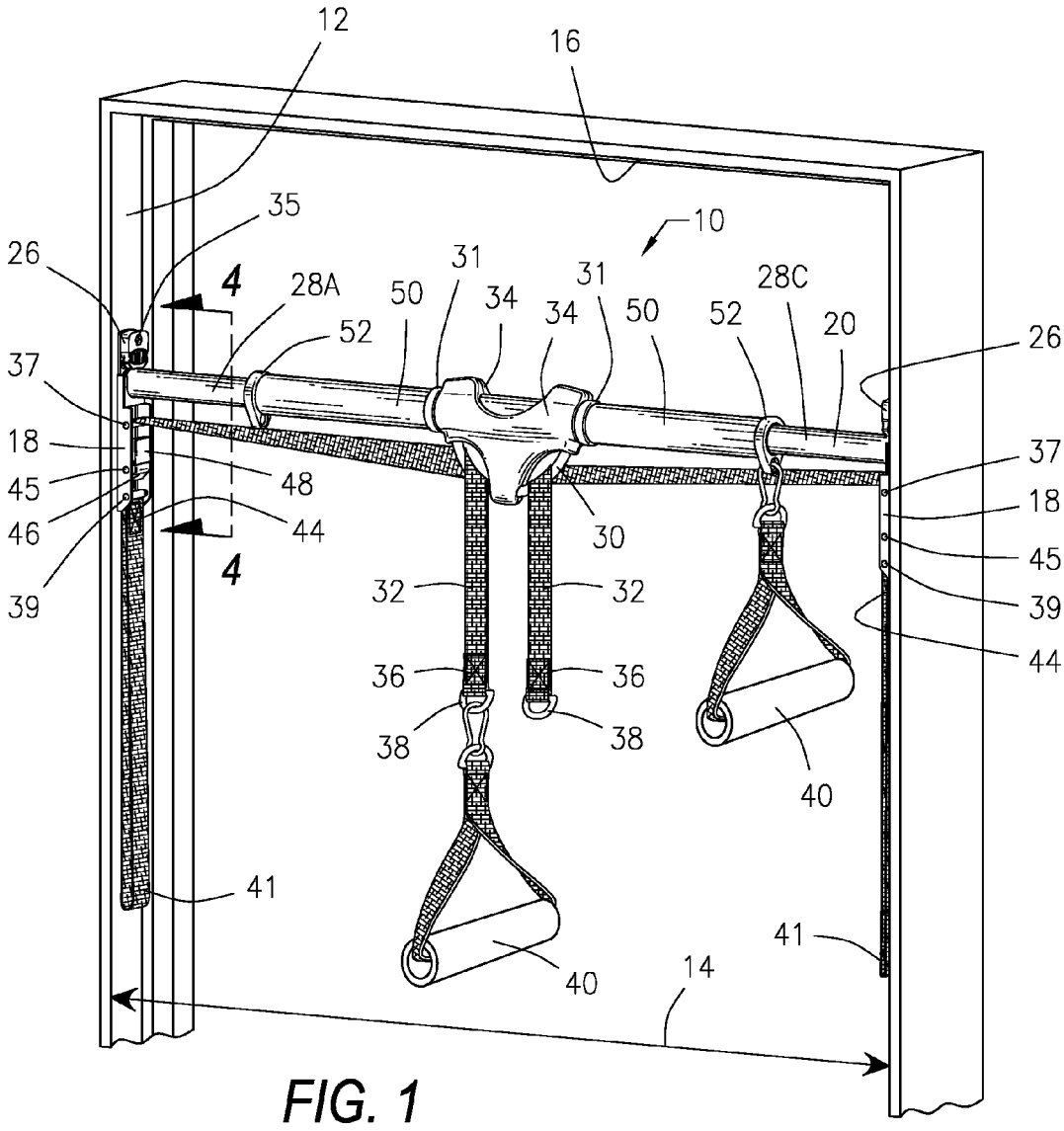
FIG. 1 is a perspective view of a suspension gym that is constructed in accordance with a preferred embodiment of the present invention.
Figure 3:
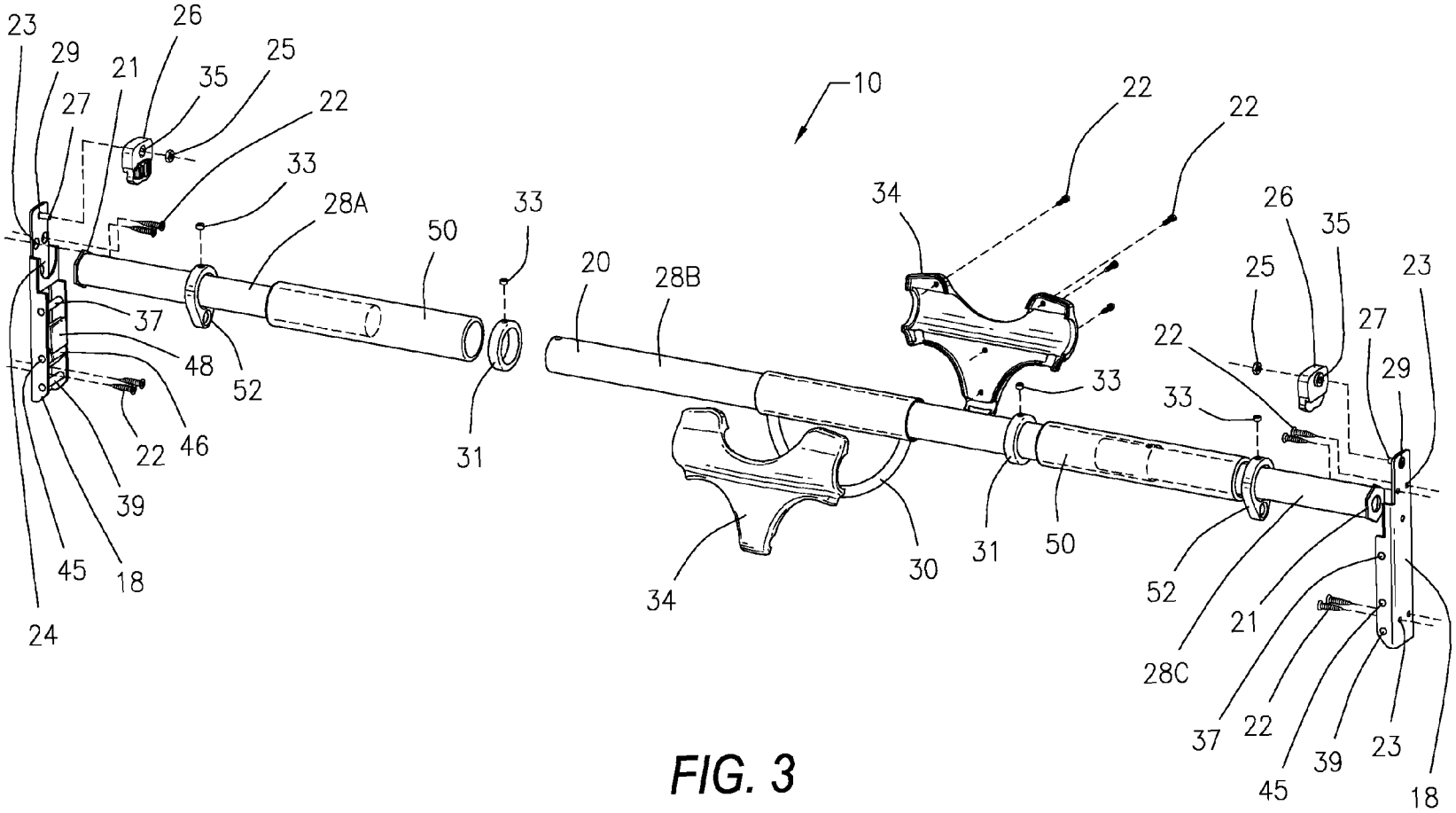
FIG. 3 is an exploded view of the suspension gym of FIG. 1, shown with the straps removed.
Figure 5A:
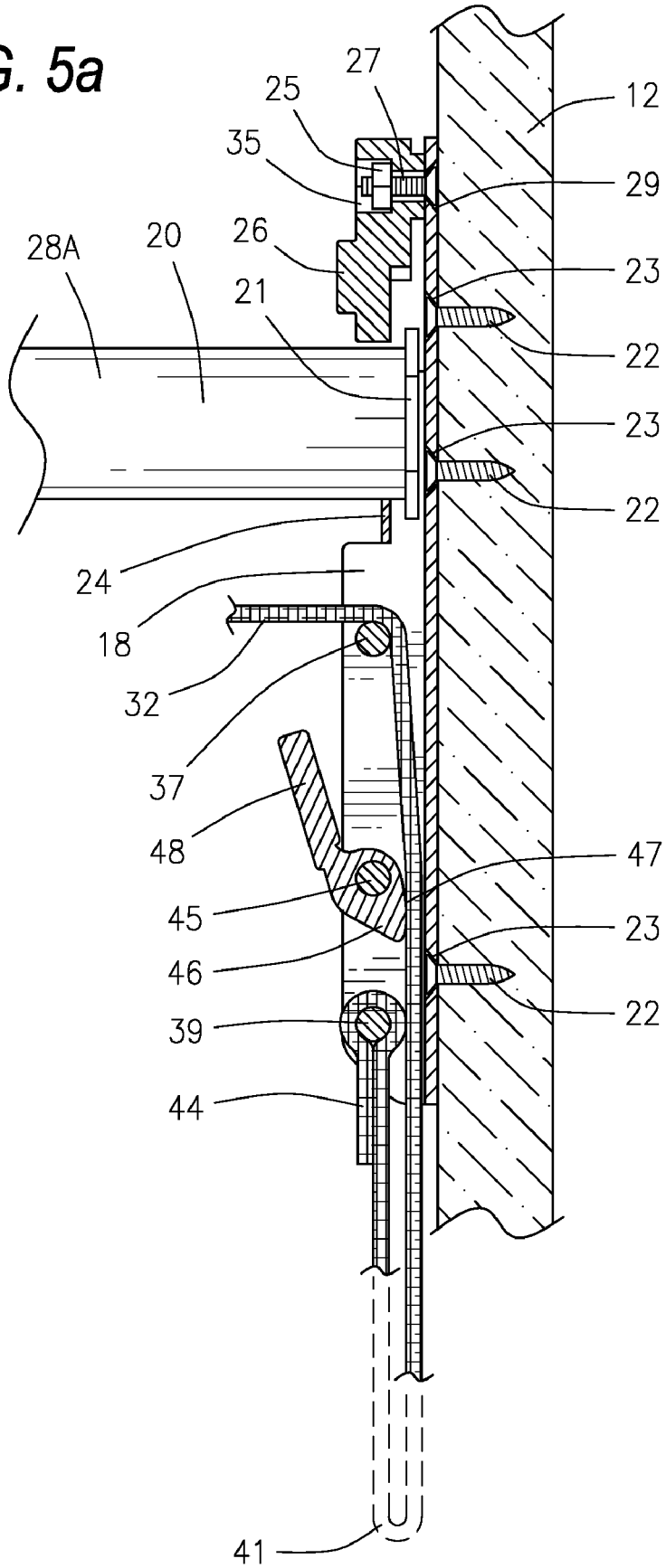
FIG. 5*a* is a cross sectional view taken along line 5*a*-5*a* of FIG. 4, showing the strap locking mechanism in its locked position with the outwardly biased press release handle extended outward.
Figure 5B:
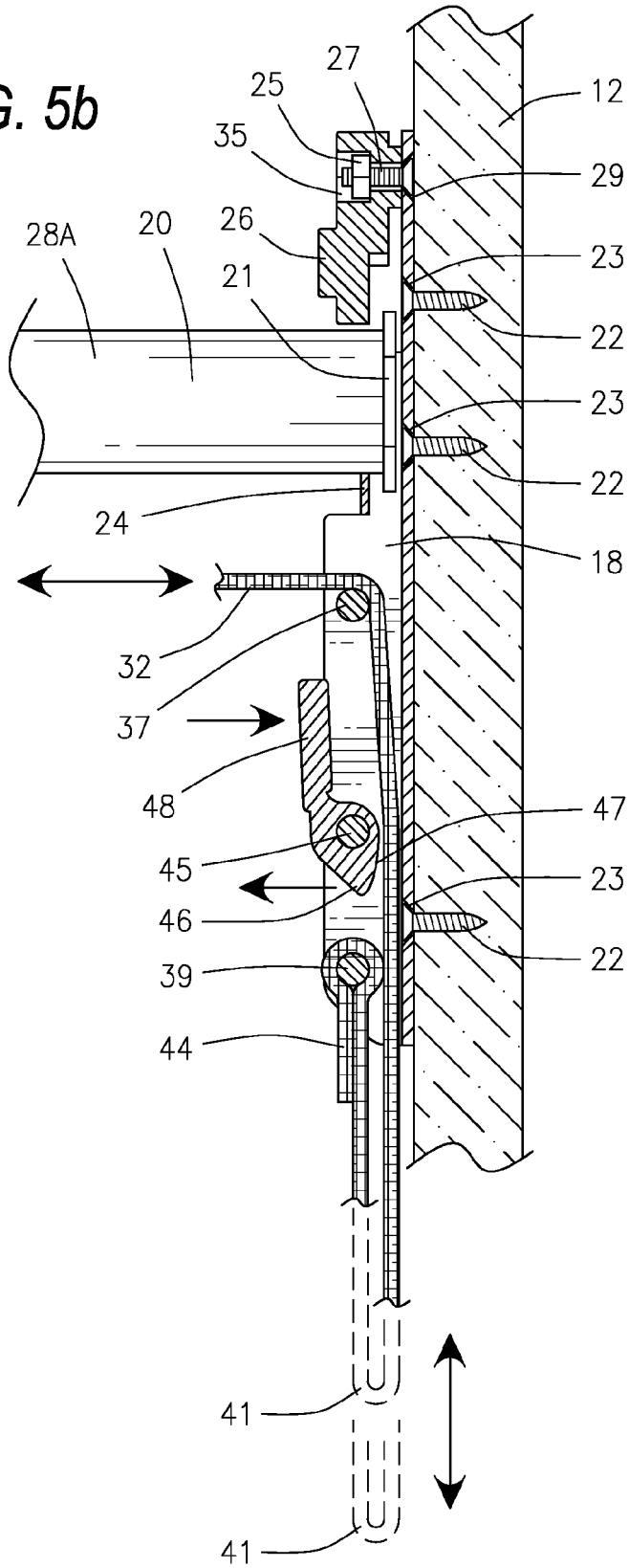
FIG. 5*b* is a cross sectional view taken along line 5*b*-5*b* of FIG. 4, showing the strap locking mechanism in its unlocked position with the outwardly biased press release handle depressed inward to allow its associated adjustable length strap to be increased or decreased in functional length.

Referring now to the drawings and initially to FIG. 1, there is illustrated a suspension gym 10 that is constructed in accordance with a preferred embodiment of the present invention. The gym 10 is shown in use suspended from a door frame 12 and extending across a doorway opening 14, preferably at the upper end 16 of the doorway opening 14. Referring also to FIG. 3, the gym 10 includes mounting brackets 18 for mounting an adjustable length rod 20 to either side of the door frame 12. The brackets 18 are secured to the door frame 12 by screws 22 or other suitable fastening means, as best seen in FIGS. 5*a* and 5*b*. The screws 22 insert through screw openings 23 provided in the brackets 18. Each bracket 18 has an upward facing trough 24 for receiving one end of the adjustable length rod 20.

Each bracket 18 also has a swivel tube lock 26 that holds the rod 20 in the trough 24. Each swivel tube lock 26 is pivotally secured to its associated bracket 18 by a swivel bolt 27 that inserts through a bolt opening provided in the bracket 18 and a nut 25 that engages the swivel bolt 27 after the swivel tube lock 26 has been attached to the swivel bolt 27 via a swivel bolt opening 35 provided in the swivel tube lock 26

The adjustable length rod 20 is preferably constructed of three tubes 28A, 28B, and 28C with the central tube 28B being of a larger diameter than the other two tubes 28A and 28C so that the two smaller end tubes 28A and 28C are telescopically received within the central tube 28B as a means of adjusting the length of the rod 20. Free ends 21 of the smaller end tubes are hex-shaped so that, when locked in their associated troughs 24 by the swivel tube lock 26, the rod 20 is prevented from rotating relative to the brackets 18 and the door frame 12 to which the brackets 18 are secured.

A rotatable central ring or connection point 30 is secured centrally on the rod 20 and supports two adjustable length straps 32. A set screw ring 31 with associated set screw 33 is provided on either side of the central ring or connection point 30 to secure the central ring or connection point 30 on the rod 20 and prevent the central ring or connection point 30 from slipping sideways on the rod 20. The central ring or connection point 30 is encased within a two piece housing 34 or case that is preferably constructed of plastic and is designed to protect the user from bumping into the central ring or connection point 30 and to help in holding the adjustable length straps 32 in the central ring or connection point 30. The two piece housing 34 is held together with screws 22 or other suitable fastening means.

Figure 2:
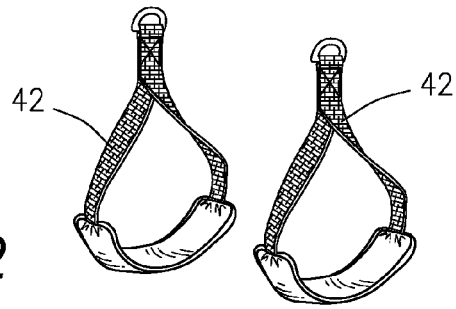
FIG. 2 is a perspective view of two ankle stirrups that are attachments for the suspension gym of FIG. 1.

Free ends 36 of the adjustable length straps 32 are provided with smaller fastening rings 38 to which hand grips 40 or ankle stirrups 42, which are illustrated in FIG. 2, are removably attachable. Each of the adjustable length straps 32 movably extends over an upper strap supporting pin 37 provided on its associated bracket 18 and then extends through a strap locking mechanism 46 provided on the bracket 18 before having its opposite end 44 permanently attached to a lower strap supporting pin 39 provided on the bracket 18. The strap locking mechanisms 46 adjustably hold the free ends 36 of the adjustable length straps 32 at the desired lengths and allow the remaining length of the adjustable length straps 32 to hang along the sides of the door frame 12 in free hanging loops 41.

Figure 4:
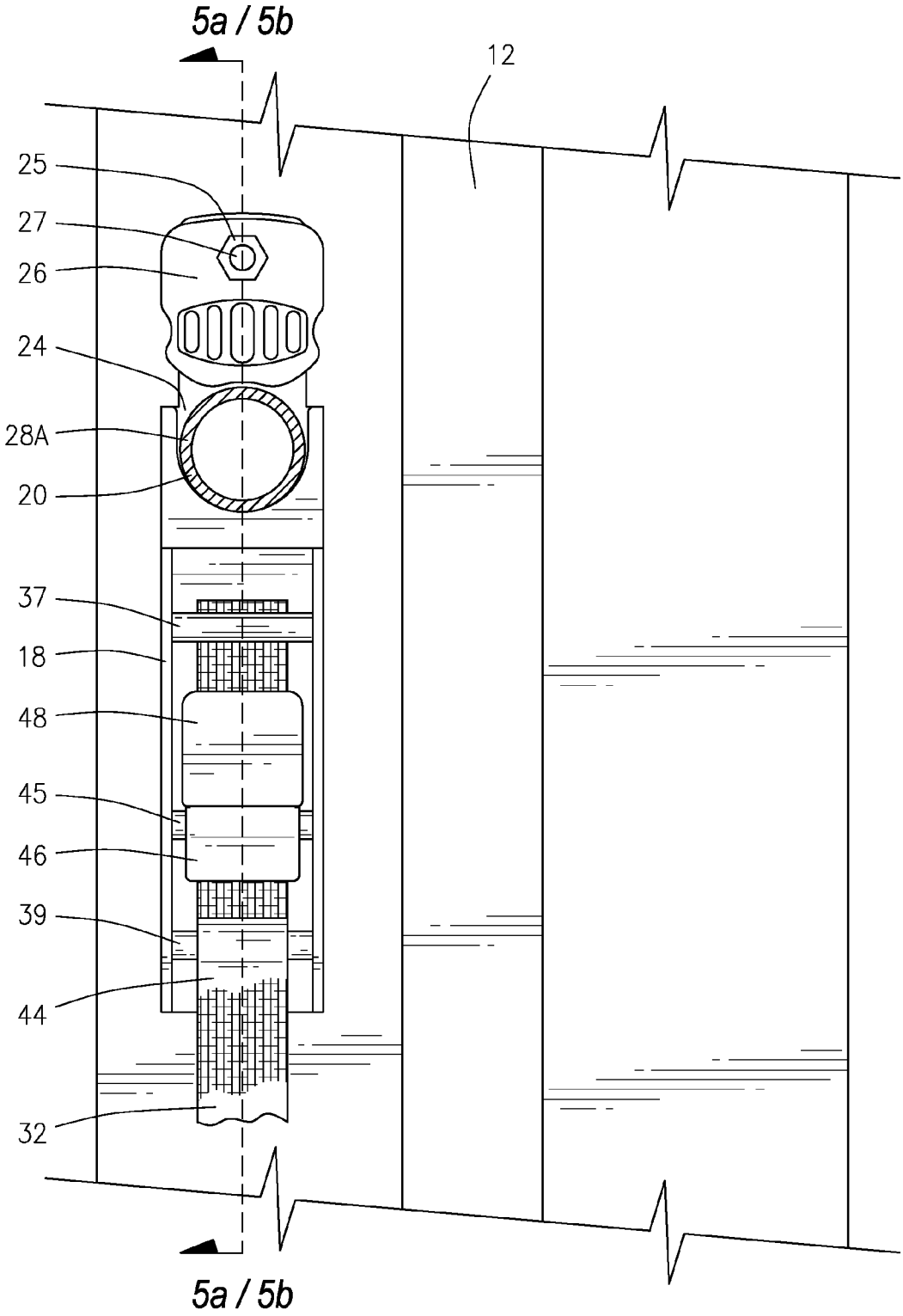
FIG. 4 is a cross sectional view taken along line 4-4 of FIG. 1.

Referring to FIGS. 4, 5*a* and 5*b*, each strap locking mechanism 46 is provided with an outwardly biased, press release handle 48. As illustrated in FIG. 5*a*, the handle is normally biased to in its locked position which locks the strap 32 against the bracket 18 by means of the strap grip 47 provided on the opposite end of the strap locking mechanism 46 from the handle 48. In the locked position, the handle 48 extends outward away from the bracket 18 and the strap 32 is removably locked between the strap grip 47 and the bracket 18.

Now referring to FIG. 5*b*, when the handle 48 is pressed inward toward the bracket 18, the strap locking mechanism 46 pivots on pivot pin 45 provided on the bracket 18, moving the strap grip 47 away from the strap 32 to an unlocked position. This movement of the handle 48 and strap grip 47 are shown by arrows in FIG. 5*b*. In this unlocked position, the strap 32 can be slid either toward or away from the central ring or connection point 30, as indicated by the upper two-ended arrow in FIG. 5*b*, thereby either increasing or decreasing the effective length of the adjustable length strap 32 at the central ring or connection point 30, as indicated by the lower two-ended arrow in FIG. 5*a* and by the two different lengths of the loop 41 that are shown in outline in FIG. 5*a*.

Once the strap 32 is positioned at the desired length, the handle 48 is allowed to return to its inwardly biased, locked position, causing the strap grip 47 to once again lock the strap 32 between the strap grip 47 and the bracket 18. The strap grip 47 is shaped in such a manner that a pulling force on the free end 36 of the strap 32 causes the strap grip 47 to more tightly engage and hold the strap 32.

Additionally, the rod 20 is provided with a pair of rubber grip sleeves 50 which extend around the rod 20 on either side of the central ring or connection point 30 that allows the user to grip the rod 20 when doing pull-ups. Also, the rod 20 is provided with a multi-purpose ring 52 and associated set screw 33 on either side of the central ring or connection point 30 to which hand grips 40 or ankle stirrups 42 are removably attachable. The multi-purpose rings 52 can be employed as a secondary handle position that is used when performing exercises such as twisting pull-ups.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A suspension gym for installation in a doorway by securing to either side of a door frame comprising:

brackets adapted to be secured to either side of a door frame, an adjustable length rod having two ends, each end of the adjustable length rod removably attaching to one of said brackets so that the adjustable length rod is suspended horizontally in a doorway of the door frame, a central connection located approximately in the middle of the adjustable length rod, and two adjustable length straps, each said adjustable length strap having a first end and a second end, said first end of each adjustable length strap suspended from the central connection, a second end of one of the two adjustable length straps adjustably secured to one of the brackets and a second end of the other of the two adjustable length straps adjustably secured to the other bracket, and gripping means removably secured to the first ends of the two adjustable length straps.

2. A suspension gym according to claim 1 wherein said gripping means are selected from the following list:

hand grips or ankle stirrups.

3. A suspension gym according to claim 1 further comprising:

rubber grip sleeves provided on said rod on either side of said central connection.

4. A suspension gym according to claim 3 further comprising:

multi-purpose rings located adjacent to said rubber grip sleeves.

5. A suspension gym according to claim 4 further comprising:

gripping means removably secured to the multi-purpose rings.

6. A suspension gym according to claim 5 wherein said gripping means are selected from the following list:

hand grips or ankle stirrups.

7. A suspension gym according to claim 1 further comprising:

a strap locking mechanism provided on each bracket as a means of adjustably securing the said second ends of the two adjustable length straps to the brackets.

8. A suspension gym according to claim 7 further comprising:

each said strap locking mechanism pivotally attached to a bracket via a pivot pin, a press release handle provided on the strap locking mechanism on one side of the pivot pin and a strap grip provided on the other side of the pivot pin so that when the strap grip moves away from the strap that is secured between the strap grip and the bracket when the press release handle pivots toward the bracket.

9. A suspension gym according to claim 8 wherein said press release handle is outwardly biased away from the bracket to hold the strap locking mechanism in a normally locked position.

10. A suspension gym according to claim 1 further comprising:

a swivel tube lock pivotally secured to the bracket as a means of removably securing the rod to the bracket so that the rod does not rotate relative to the bracket.

11. A suspension gym according to claim 1 further comprising:

fastening means inserted through openings in said brackets and engaging the door frame as a means of securing the brackets to the door frame.

12. A suspension gym according to claim 1 wherein the central connection is rotatably secured to the adjustable length rod.

* * * * *